US011175619B2

(12) United States Patent
Tao

(10) Patent No.: US 11,175,619 B2
(45) Date of Patent: Nov. 16, 2021

(54) IMAGE FORMING APPARATUS

(71) Applicant: KYOCERA Document Solutions Inc., Osaka (JP)

(72) Inventor: Kozo Tao, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 126 days.

(21) Appl. No.: 16/739,785

(22) Filed: Jan. 10, 2020

(65) Prior Publication Data

US 2020/0225609 A1 Jul. 16, 2020

(30) Foreign Application Priority Data

Jan. 16, 2019 (JP) ..... JP2019-005494

(51) Int. Cl.
*G03G 15/00* (2006.01)

(52) U.S. Cl.
CPC ..... *G03G 15/607* (2013.01); *G03G 15/6511* (2013.01); *G03G 2215/00206* (2013.01); *G03G 2215/00329* (2013.01)

(58) Field of Classification Search
CPC ..... G03G 15/607; G03G 15/6511; G03G 2215/00329; G03G 2215/00206; G03G 2215/00729; G03G 15/6514; H04N 1/00623; H04N 1/00408
See application file for complete search history.

(56) References Cited

U.S. PATENT DOCUMENTS

2014/0022588 A1* 1/2014 Takeuchi ..... H04N 1/00416 358/1.15
2017/0341889 A1* 11/2017 Kikuta ..... B41J 13/103
2018/0348687 A1* 12/2018 Arai ..... G03G 15/607

FOREIGN PATENT DOCUMENTS

JP H11-91202 A 4/1999

* cited by examiner

*Primary Examiner* — Susan S Lee
(74) *Attorney, Agent, or Firm* — Studebaker & Brackett PC

(57) ABSTRACT

An image forming apparatus includes a medium storing part storing mediums, a sheet feeding part feeding the medium from the medium storing part, an image forming part forming an image to the medium, a residual quantity detecting part, a storage part, and a residual medium estimating part. The residual quantity detecting part detects a residual quantity of the mediums stored in the medium storing part as a relative residual quantity with regard to a maximum storing quantity of the mediums in the medium storing part. The storage part stores maximum storing number of the mediums corresponding to the maximum storing quantity of the medium storing part. The residual medium estimating part calculates number of estimated residuals of the mediums stored in the medium storing part on the basis of the relative residual quantity detected by the residual quantity detecting part and the maximum storing number stored in the storage part.

10 Claims, 7 Drawing Sheets

FIG. 4

PC

| ITEM NAME | MEDIUM M1 | MEDIUM M2 | MEDIUM M3 | ··· |
|---|---|---|---|---|
| SIZE | A4 | A4 | A4 | ··· |
| BASIS WEIGHT (gsm) | 80 | 120 | 360 | ··· |
| MAXIMUM STORING NUMBER: MANUAL BYPASS TRAY | 155 | 140 | 120 | ··· |
| MAXIMUM STORING NUMBER: STANDARD CARTRIDGE | 510 | 470 | 420 | ··· |
| MAXIMUM STORING NUMBER: LARGE CAPACITY DECK | 2600 | 2300 | 2000 | ··· |

FIG. 6

| MEDIUM STORING PART | MEDIUM TYPE | 0% | 10% | 20% | 30% | 40% | 50% | 60% | 70% | 80% | 90% | 100% |
|---|---|---|---|---|---|---|---|---|---|---|---|---|
| MANUAL BYPASS TRAY | MEDIUM M1 | 0 | – | – | – | – | – | – | – | – | – | 155 |
| | MEDIUM M2 | 0 | – | – | – | – | – | – | – | – | – | 140 |
| | MEDIUM M3 | 0 | – | – | – | – | – | – | – | – | – | 120 |
| STANDARD CARTRIDGE | MEDIUM M1 | 0 | – | 102 | – | 204 | – | 306 | – | 408 | – | 510 |
| | MEDIUM M2 | 0 | – | 94 | – | 188 | – | 282 | – | 376 | – | 470 |
| | MEDIUM M3 | 0 | – | 84 | – | 168 | – | 252 | – | 336 | – | 420 |
| LARGE CAPACITY DECK | MEDIUM M1 | 0 | 260 | 520 | 780 | 1040 | 1300 | 1560 | 1820 | 2080 | 2340 | 2600 |
| | MEDIUM M2 | 0 | 230 | 460 | 690 | 920 | 1150 | 1380 | 1610 | 1840 | 2070 | 2300 |
| | MEDIUM M3 | 0 | 200 | 400 | 600 | 800 | 1000 | 1200 | 1400 | 1600 | 1800 | 2000 |

FIG. 7

| | PAPER SIZE | PAPER TYPE | MAXIMUM STORING NUMBER | RELATIVE RESIDUAL QUANTITY | NUMBER OF ESTIMATED RESIDUALS |
|---|---|---|---|---|---|
| MANUAL BYPASS TRAY 4 | A4 | CARDBOARD | 150 | 100% | 150 |
| SHEET FEEDING CARTRIDGE 3a | A4 | RECYCLED PAPER | 250 | 50% | 125 |
| SHEET FEEDING CARTRIDGE 3b | A3 | PLAIN PAPER | 500 | 75% | 375 |
| SHEET FEEDING CARTRIDGE 3c | A3 | PLAIN PAPER | 500 | 25% | 125 |
| SHEET FEEDING CARTRIDGE 3d | A4 | PLAIN PAPER | 1500 | 20% | 300 |
| SHEET FEEDING CARTRIDGE 3e | A4 | PLAIN PAPER | 2500 | 75% | 1875 |

IMAGE FORMING APPARATUS

INCORPORATION BY REFERENCE

This application is based on and claims the benefit of priority from Japanese Patent application No. 2019-005494 filed on Jan. 16, 2019, the entire contents of which are incorporated herein by reference.

BACKGROUND

The present disclosure relates to an image forming apparatus including a medium storing part storing mediums and a residual quantity detecting part detecting a residual quantity of the mediums.

An image forming apparatus of an electrographic manner, such as a copying machine or a printer, performs image forming to a medium, such as a recording paper. The above-mentioned medium is stored in a medium storing part, such as a sheet feeding cartridge or a manual bypass tray, provided in the image forming apparatus, and is fed under control by a controlling device to become an object for image forming.

Understandably, if the mediums in the sheet feeding cartridge and the manual bypass tray are used up, image forming becomes impossible. A grasp of number of the mediums remaining in the medium storing part is important for maintaining availability of the image forming apparatus.

Conventionally, various techniques for grasping the number of the mediums have been proposed. For example, there is a known image forming apparatus, such as a printing device, having a sheet presence/absence sensor detecting a sheet absence state and a sheet residual quantity sensor detecting a small state of residual sheets. In the above-mentioned printing device, when the sheet residual quantity in a sheet tray becomes small, a value of number of the sheet counted until the sheet is used up is stored in an NVRAM, and the value is set to number of the sheet residual quantity in the next detecting of the sheet residual quantity.

In the above-mentioned conventional technique, after the small state of the residual sheets is detected, detection accuracy of the number of the sheet residual quantity may be improved, but particular consideration is not provided before the small state is detected. Therefore, there is a possibility that it is difficult to appropriately estimate number of residuals of the mediums, such as the sheets.

SUMMARY

An image forming apparatus of the present disclosure includes at least one medium storing part storing mediums, a sheet feeding part, an image forming part, a residual quantity detecting part, a storage part, and a residual medium estimating part. The sheet feeding part feeds the medium from the medium storing part. The image forming part performs image forming to the medium fed from the sheet feeding part. The residual quantity detecting part detects a residual quantity of the mediums stored in the medium storing part as a relative residual quantity with regard to a maximum storing quantity of the mediums which can be stored in the medium storing part. The storage part stores maximum storing number of the mediums corresponding to the maximum storing quantity of the mediums of the medium storing part. The residual medium estimating part calculates number of estimated residuals of the mediums stored in the medium storing part on the basis of the relative residual quantity detected by the residual quantity detecting part and the maximum storing number of the mediums stored in the storage part.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 4 is a table of an example of medium catalog information according to the embodiment of the present disclosure.

FIG. 6 is a table of calculated values of number of estimated residuals of mediums according to the embodiment of the present disclosure.

FIG. 7 is a table of number of estimated residuals of mediums according to a modified example of the present disclosure.

DETAILED DESCRIPTION

Hereinafter, with reference to the drawings, an embodiment of the present disclosure will be described. In the present embodiment, a configuration of an image forming apparatus according to the present disclosure will be described in a case in which the image forming apparatus is applied to a multifunction peripheral 1 (MFP) including a print function, a copy function, a facsimile function, a data transmission/reception function and others in a compound manner. Hereinafter, for the sake of convenience, it will be described so that the front side of the multifunction peripheral 1 is positioned at a near side on a paper sheet of FIG. 1

1. Whole Structure of Multifunction Peripheral (Image Forming Apparatus)

Figure 1:
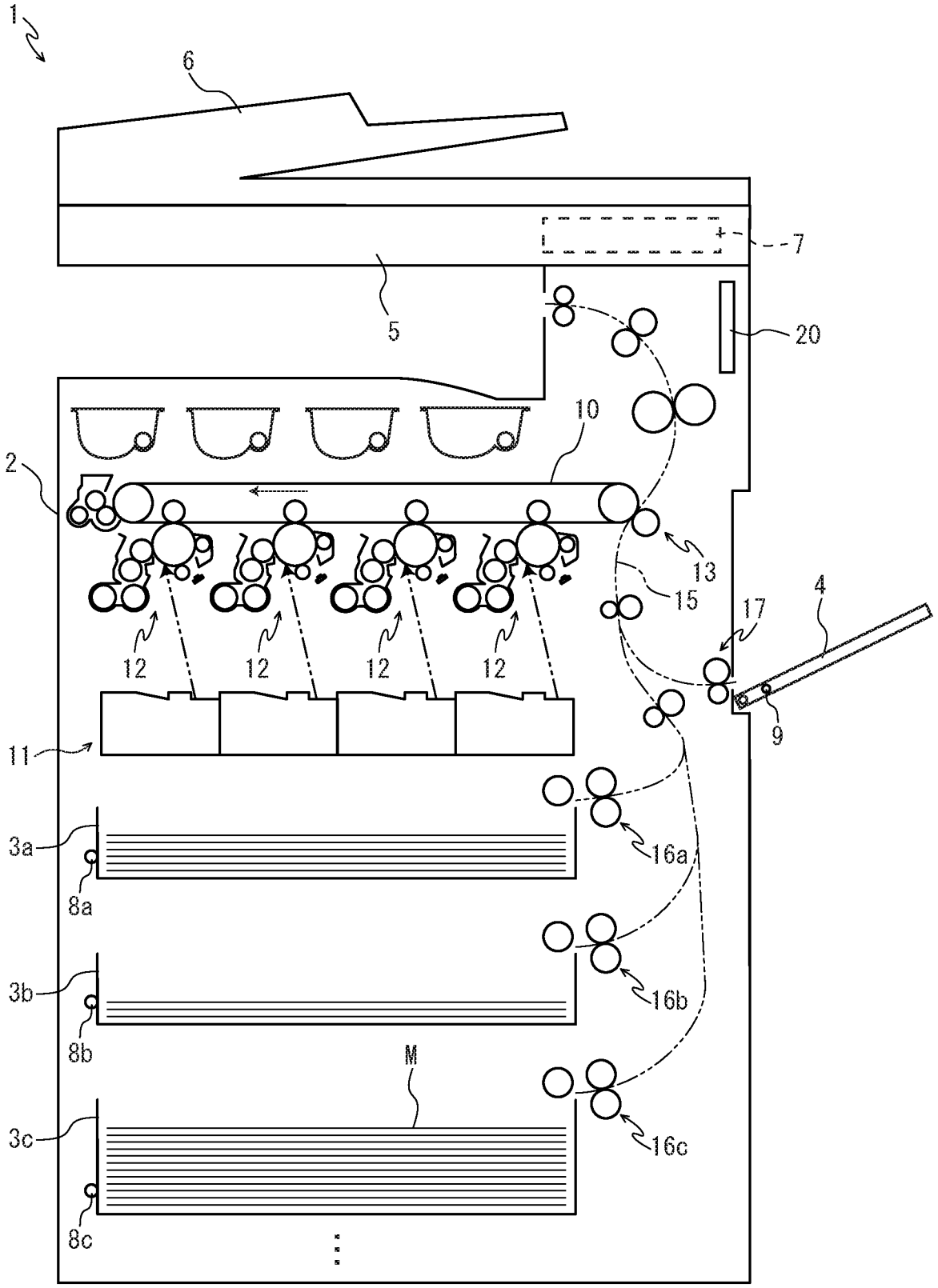
FIG. 1 is a sectional view showing a multifunction peripheral according to an embodiment of the present disclosure.

As indicated in FIG. 1, the multifunction peripheral 1 includes a roughly box-shaped apparatus body 2. In a lower part of the apparatus body 2, a plurality of sheet feeding cartridges 3 (3*a*, 3*b*, 3*c*, . . . ) are housed and detachably attached to store mediums M, such as recording papers, inside the multifunction peripheral 1. The sheet feeding cartridge 3 is an example of a medium storing part. The sheet feeding cartridges 3*a* and 3*b* are standard cartridges and can store 500 standard mediums M. On the other hand, the sheet feeding cartridge 3*c* is a large capacity deck and can store 2500 standard mediums M.

At a right side part of the apparatus body 2, a manual bypass tray 4 storing the mediums M, such as recording papers, outside the multifunction peripheral 1 (on which the mediums M are placed) is openably/closably provided. The manual bypass tray 4 is another example of the medium storing part and can store 150 standard mediums M. Incidentally, the multifunction peripheral 1 may include at least one medium storing part.

In a sheet ejecting space in an upper part of the apparatus body 2, an ejected sheet tray is provided. The sheet feeding cartridges 3, the manual bypass tray 4, and the ejected sheet tray are used for conveying the medium M onto which an image is formed in image forming parts 12 in the apparatus body 2.

In the upper part of the apparatus body 2, an image reading device 5 reading a reading object, such as a document or the like and outputting scan data is provided. At an upper side of the image reading device 5, a document conveying part 6 including an auto document conveying device (Auto Document Feeder, ADF) feeding the document to the image reading apparatus 5 and others is provided. The document conveying part 6 is attached so as to be openable and closable with regard to the image reading apparatus 5.

Moreover, on the upper part the apparatus body 2, an operation display unit 7 (a display part) used for operation of a user is installed at a front side. The operation display unit 7 includes, for example, operation keys, such as numeric keys, a start key, a system menu key, a transmission key, a copy key, a confirmation key and others, and a display device, such as a touch panel or the like, and can display number of estimated residual of the mediums M.

In the plurality of sheet feeding cartridges 3 (3*a*, 3*b*, 3*c*, . . . ), respective residual sensors 8 (8*a*, 8*b*, 8*c*, . . . ) are provided. The residual sensors 8*a* and 8*b* corresponding to the sheet feeding cartridges 3*a* and 3*b* as the standard cartridges are, for example, rotation sensors with lift-up motors, and output respective signals indicating residuals of the mediums M stored in the sheet feeding cartridges 3*a* and 3*b* by the percentages of maximum storing quantities of the sheet feeding cartridges 3*a* and 3*b*. The above-described signal indicates a relative residual quantity of the mediums M at intervals of 20% within a range from 0% to 100% (i.e. in 6 stages).

The residual sensor 8*c* corresponding to the sheet feeding cartridge 3*c* as the large capacity deck is, for example, a rotation sensor with a lift-up motor, and output a signal indicating residuals of the mediums M stored in the sheet feeding cartridge 3*c* by the percentage of a maximum storing quantity of the sheet feeding cartridge 3*c*. The above-described signal indicates a relative residual quantity of the mediums M at intervals of 10% within a range from 0% to 100% (i.e. in 11 stages).

In the manual bypass tray 4, a residual sensor 9 is provided. The residual sensor 9 is, for example, an optical sensor, and outputs a signal indicating whether or not the medium M is stored in (placed on) the manual bypass tray 4. That is, the signal outputted by the residual sensor 9 indicates a relative residual quantity of the mediums M by 0% or 100%.

In other words, each residual sensor (each residual quantity detecting part) 8 or 9 is an element detecting and outputting residuals of the mediums M stored in the corresponding medium storing part as the relative residual quantity with regard to the maximum storing quantity of the mediums M which can be stored in the medium storing part. In detail, each residual sensor 8 or 9 detects and outputs the relative residual quantity as discrete value of percentage value set in stages. As described above, detecting granularity of the relative residual quantity may be different among the residual sensor 8 and 9.

In a middle part of the apparatus body 2, an intermediate transferring belt 10 is wound around a plurality of rollers. Below the intermediate transferring belt 10, an exposing device 11 including a laser scanning unit (LSU) is provided. Along a lower side face of the intermediate transferring belt 10, four image forming parts 12 are provided for respective colors of toner (for example, four colors of yellow, cyan, magenta and black).

Each of the image forming parts 12 includes a rotatable photosensitive drum, and a charging device, a developing device, a primary transferring part, a cleaning device, and a static eliminating device are arranged around the photosensitive drum in an order of primary transferring process. At a right end side of the intermediate transferring belt 10, a secondary transferring part 13 is provided, and the secondary transferring part 13 is composed of a part at the right end side of the intermediate transferring belt 10 and a secondary transferring roller. At a left end side of the intermediate transferring belt 10, a cleaning device cleaning the intermediate transferring belt 10 is provided. That is, each image forming part 12 is an element performing image forming to the medium M, such as sheet or the like.

In a right part of the apparatus body 2, a conveying path 15 for the medium M is provided. At an upstream part of the conveying path 15, a plurality of sheet feeding parts 16 (16*a*, 16*b*, 16*c*, . . . ) composed of sheet feeding rollers and others are provided respectively corresponding to the plurality of sheet feeding cartridges 3 (3*a*, 3*b*, 3*c*, . . . ). The sheet feeding part 16 feeds the mediums M from the corresponding sheet feeding cartridge 3 to the conveying path 15. At a midstream part of the conveying path 15, the above-described secondary transferring part 13 is provided. Moreover, the conveying path 15 is connected to the manual bypass tray 4 at a downstream side of the sheet feeding cartridges 3 and at an upstream side of the secondary transferring part 13. In a vicinity of the manual bypass tray 4, a sheet feeding part 17 composed of a sheet feeding roller and others is provided. The sheet feeding part 17 feeds the mediums M from the manual bypass tray 4 to the conveying path 15. At a downstream part of the conveying path 15, a fixing device is provided and, at a downstream end of the conveying path 15, a sheet ejecting port is provided. Moreover, the apparatus body 2 includes a control device 20 controlling components of the multifunction peripheral 1.

2. Summary of Image Forming Operation

Next, image forming operation of the above-described multifunction peripheral 1 will be described. When power of the multifunction peripheral 1 is turned on, the control device 20 executes initializing of various parameters and others. In the multifunction peripheral 1, data for printing is inputted from the image reading device 5, external computers and others, and when start of printing is instructed, the image forming operation is performed under control by the control device 20 as follow.

First, the control device 20 creates output image data to be an object of image forming. Then, under control by the control device 20, in each image forming part 12, an electrostatic latent image is formed on the photosensitive drum by exposing the photosensitive drum with the exposing device 11 on the basis of the output image data after the photosensitive drum is electrically charged by the charging device.

The electrostatic latent image on the photosensitive drum is developed to a toner image of each color by the developing device. The toner image on the photosensitive drum is primarily transferred on a surface of the intermediate transferring belt 10 by the primary transferring part. The four image forming parts 12 sequentially perform above-described operations, and thereby, a full color toner image (a color toner image) is formed on the intermediate transferring belt 10. The color toner image is supplied to the secondary transferring part 13 at a predetermined secondary transferring timing by rotation of the intermediate transferring belt 10.

On the other hand, the medium M stored in the sheet feeding cartridge 3 or the manual bypass tray 4 is fed by the sheet feeding part 16 or the sheet feeding part 17, and is conveyed on the conveying path 15. Then, the medium M on the conveying path 15 is conveyed to the secondary transferring part 13 at the above-described predetermined secondary transferring timing. In the secondary transferring part 13, the color toner image on the intermediate transferring belt 10 is secondarily transferred on the medium M. The medium M having the secondary transferred color toner image is conveyed to a downstream side on the conveying path 15, the color toner image is fixed to the medium M by the fixing device, and then, the medium M is ejected from the sheet ejecting port to the ejected sheet tray.

3. Electrical Structure

Figure 2:
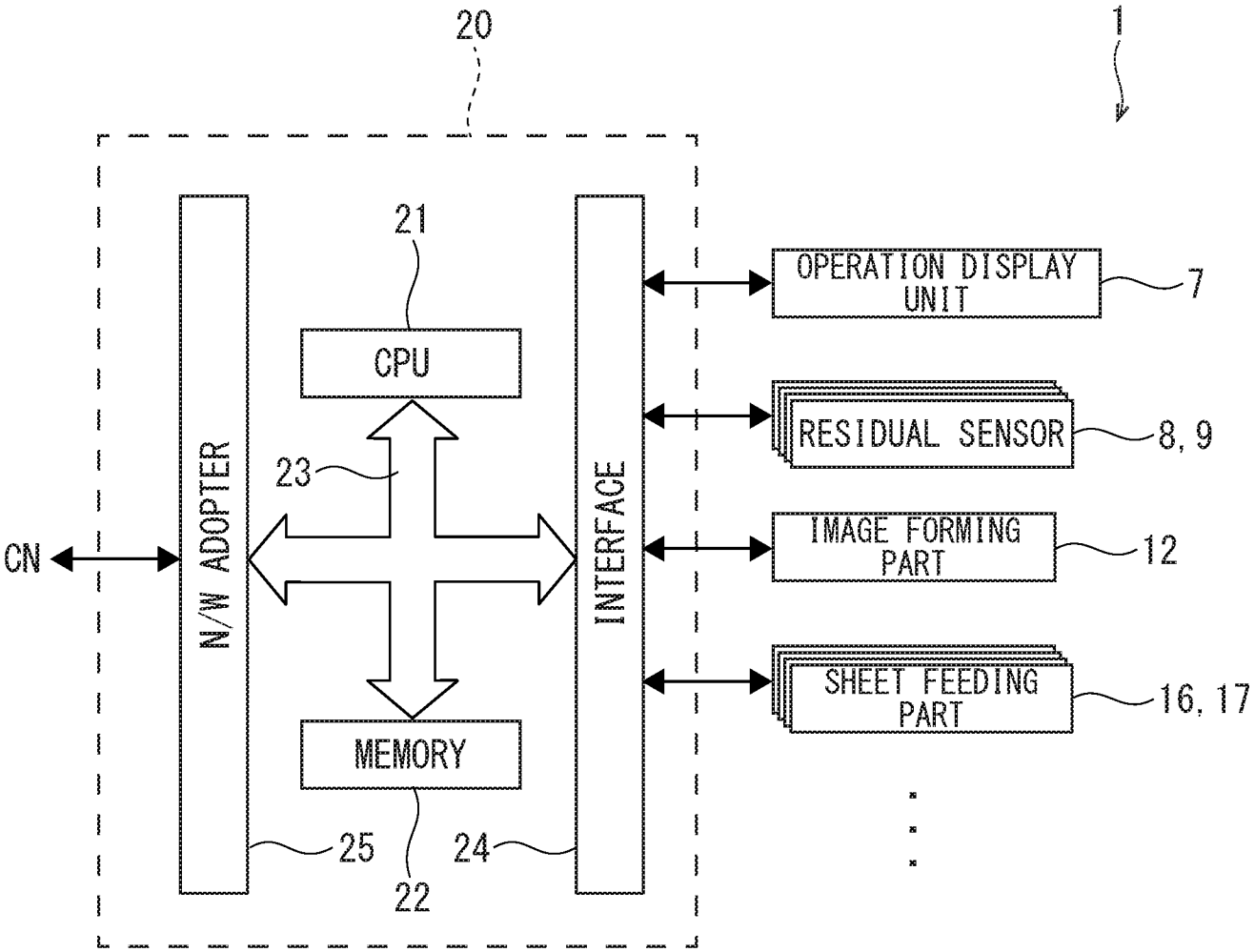
FIG. 2 is a block diagram showing an electrical structure related to a control device of the multifunction peripheral according to the embodiment of the present disclosure.

With reference to FIG. 2, the control device 20 included in the multifunction peripheral 1 will be described. FIG. 2 is a block diagram showing an electrical structure of the control device 20 and its related components. In outline, the control device 20 is electrically connected to components of the multifunction peripheral 1 to control functions of the multifunction peripheral 1.

As shown in FIG. 2, the control device 20 includes a CPU (Central Processing Unit) 21, a ROM (Read Only Memory), a RAM (Random Access Memory), a memory 22 composed of a storage device, such as a flash memory or the like, a bus 23 used for signal transfer between components, an interface 24 as a contact with each component of the multifunction peripheral 1, and a network (N/W) adopter 25 as a contact with a communication network CN.

The CPU 21 executes arithmetic process on the basis of control program and control data stored in the memory 22. The memory 22 stores the control program, the control data and others used for the arithmetic process of the CPU 21, and temporarily stores arithmetic result and others of the CPU 21.

The bus 32 connects the CPU 21, the memory 22, the interface 24, and the N/W adopter 25 with each other. To the interface 24, each component (for example, the operation display unit 7, the residual sensor 8 and 9, the image forming parts 12, the sheet feeding parts 16 and 17 and others) of the multifunction peripheral 1 is electrically connected. The N/W adopter 25 is connected to the communication network CN.

4. Logical Structure

Figure 3:
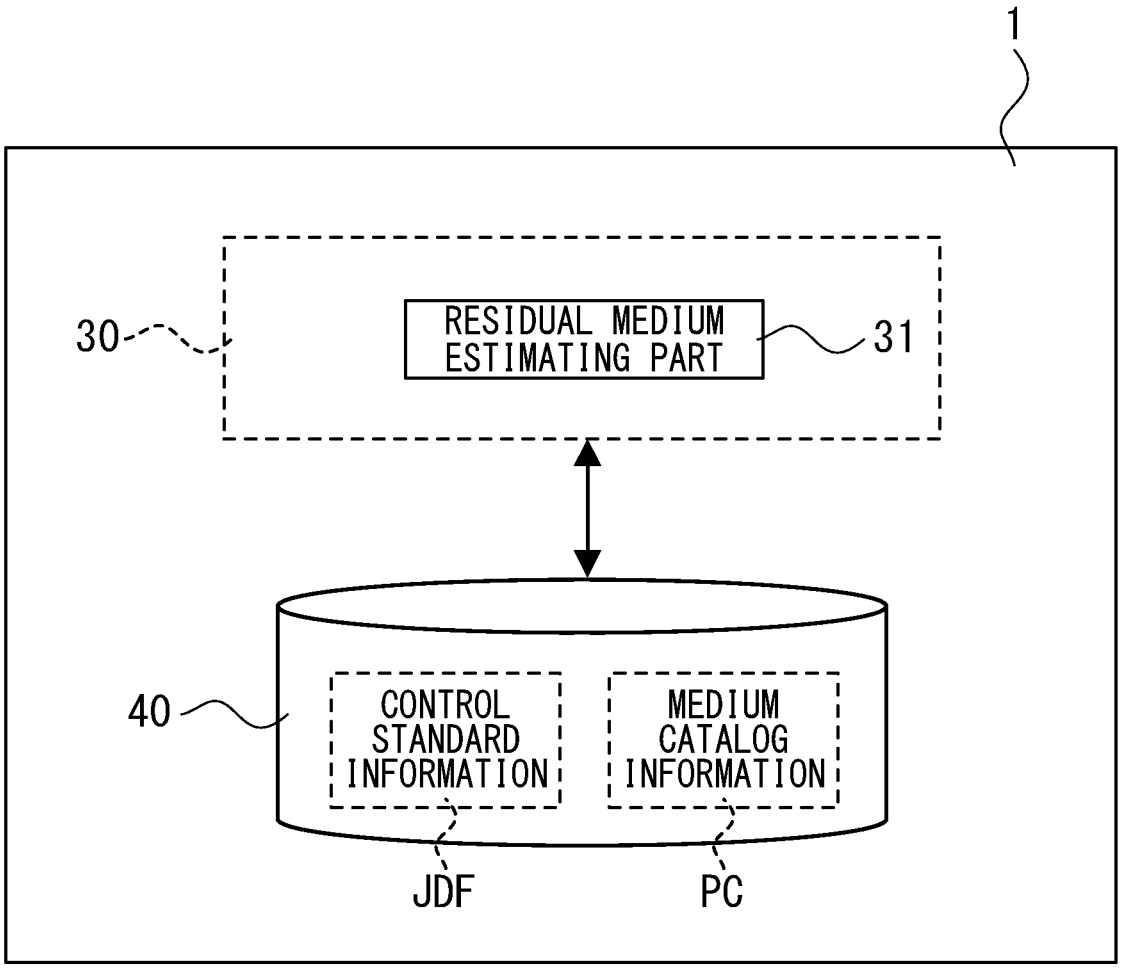
FIG. 3 is a block diagram of a logical structure of the multifunction peripheral according to the embodiment of the present disclosure.

With reference to FIG. 3, a logical structure actualized by the multifunction peripheral 1 (particularly, the controlling device 20) will be described. The multifunction peripheral 1 includes a controlling part 30 as a function block configured in a software manner by operation of the control device 20, and a storage part 40 logically configured by the memory 22. The controlling part 30 includes, as the function block, a residual medium estimating part 31.

The storage part 40 stores maximum storing number of the mediums M corresponding to the maximum storing quantity of the mediums M about the sheet feeding cartridges 3 (3*a*, 3*b*, 3*c*, . . . ) and the manual bypass tray 4. In detail, the storage part 40 stores control standard information JDF including component control information relating to operation control of image forming and standard information for each type of the medium M to be the object of image forming, and medium catalog information (e.g. paper catalog) PC including attribute information relating to the medium M for each type of the medium M. In the standard information of the control standard information JDF, thickness, weight, medium color and others are included as attribute information of each medium M, but information corresponding to the multifunction peripheral 1 is not included. The medium catalog information PC is information set depending on each multifunction peripheral 1, and the maximum storing number of the mediums M for each type of the medium M and for each medium storing part (the sheet feeding cartridges 3 (3*a*, 3*b*, 3*c*, . . . ) and the manual bypass tray 4) is appended to the medium catalog information PC.

In FIG. 4, an example of the medium catalog information PC is illustrated. The medium catalog information PC of this example corresponds to a medium M1, a medium M2 and a medium M3 as types of the medium M, and includes a basis weight [gsm (G/m2)] of the medium M, the maximum storing number of the mediums M in the manual bypass tray 4, the maximum storing number of the mediums M in the standard cartridge (the sheet feeding cartridges 3*a* and 3*b*), and the maximum storing number of the mediums M in the large capacity deck (the sheet feeding cartridge 3*c*) for each type of the medium M as attribute information. The mediums M being different in type differ in characteristics, such as a basis weight, a thickness or a surface treatment state, and therefore, differ in the maximum storing number of the mediums M in the same medium storing part.

The residual medium estimating part 31 calculates number of estimated residuals of the mediums M stored in the medium storing part (the sheet feeding cartridges 3 (3*a*, 3*b*, 3*c*, . . . ) and the manual bypass tray 4) on the basis of the relative residual quantity of the mediums M detected by the residual sensor 8 and 9 and the maximum storing number of the mediums M stored in the storage part 40. The residual medium estimating part 31 executes a query with regard to the medium catalog information PC by using the type (M1, M2, M3, . . . ) of the medium M included in the control standard information JDF as a main key. That is, the main key of the medium catalog information PC is the type of the medium M. The above-described function block is actualized by making the CPU 21 execute the control program stored in the memory 22.

5. Calculating Process of the Number of Estimated Residuals of Mediums

Figure 5:
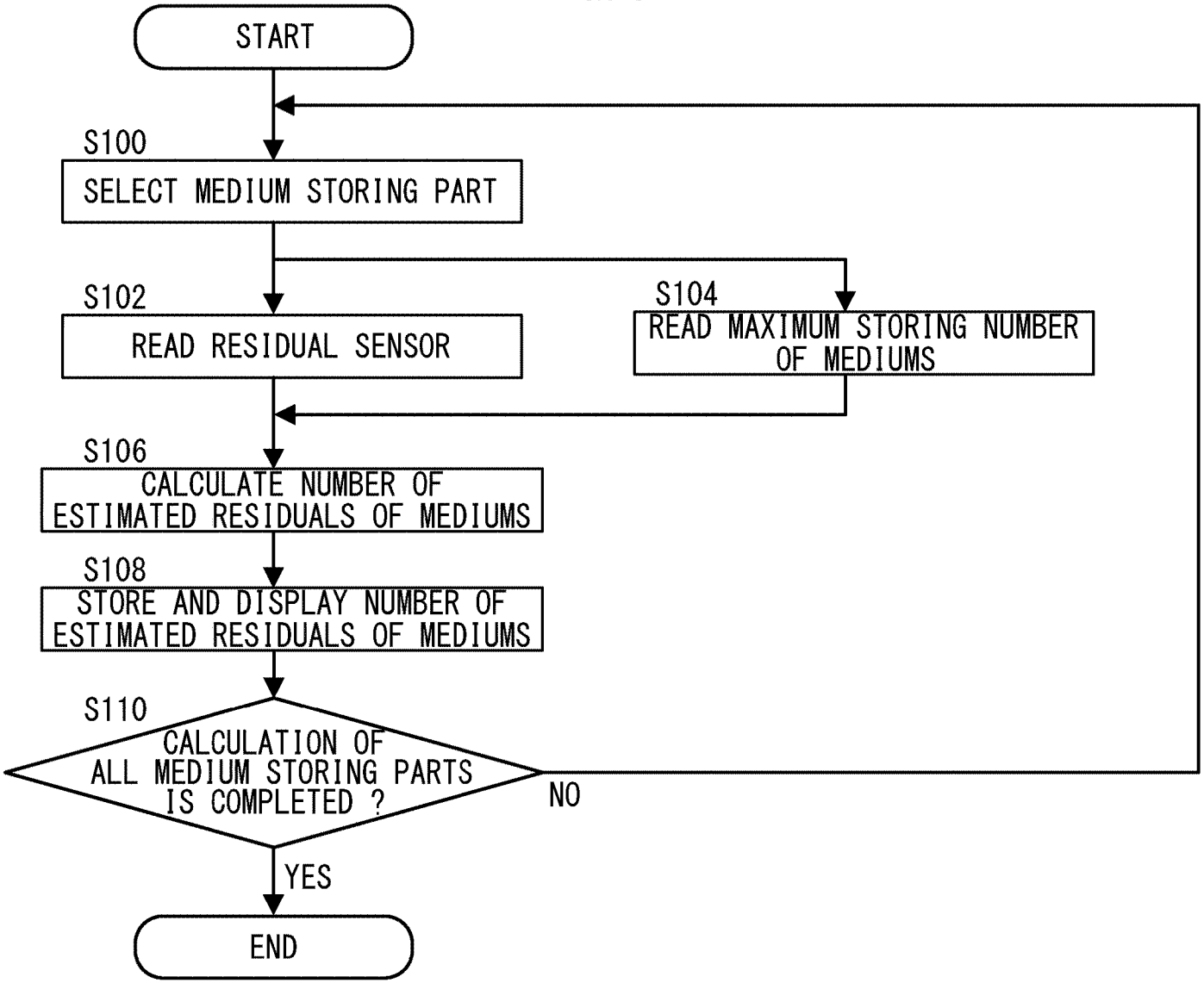
FIG. 5 is a flow chart of calculating process of number of estimated residuals of mediums according to the embodiment of the present disclosure.

Next, calculating process of the number of the estimated residuals of the mediums according to the present embodiment will be described. FIG. 5 is a flow chart of the calculating process of the number of the estimated residuals of the mediums according to the embodiment. This process can be executed at arbitrary time. For example, this process can be at a time when the multifunction peripheral 1 is activated, the multifunction peripheral 1 is restored from a sleep state, or printing process for one medium or in one series is completed.

First, at step S100, the residual medium estimating part 31 selects the medium storing part (the sheet feeding cartridge 3 or the manual bypass tray 4) to be an object of estimating of number of the residuals of the mediums. Incidentally, an order of selecting of the medium storing parts by the residual medium estimating part 31 may be arbitrarily determined. This example will be described on the assumption that the sheet feeding cartridge 3*a* storing the medium M1 is selected.

With regard to the selected sheet feeding cartridge 3*a*, the residual medium estimating part 31 reads the signal outputted from the residual sensor 8*a* corresponding to the sheet feeding cartridge 3*a* (step S102). As described above, the above-described signal is a signal indicating the relative residual quantity of the medium M as discrete value of percentage value. This example will be described on the assumption that the residual sensor 8*a* outputs the signal indicating "60%".

In parallel to step S102, the residual medium estimating part 31 obtains (reads) the maximum storing number of the mediums M1 stored in the selected sheet feeding cartridge 3*a* (step S104). In detail, the residual medium estimating part 31 reads the maximum storing number of the mediums M1 corresponding to the medium type and the medium storing part (i.e. "510 mediums" corresponding to the medium M1 and the standard cartridge) from the medium catalog information PC with regard to the sheet feeding cartridge 3*a* storing the medium M1.

Incidentally, step S102 and step S104 may be executed in parallel as described above, or may be executed in an arbitrary order in series.

Next, the residual medium estimating part 31 calculates the number of the estimated residuals of the mediums M1 stored in the sheet feeding cartridge 3*a* by multiplying the discrete value indicating the relative residual quantity (in this example, 60%) read at step S102 by the maximum storing number of the mediums M1 (in this example, 510 mediums) read at step S104 (step S106). FIG. 6 is a table listing calculated values of the number of the estimated residuals calculated on the basis of the relative residual quantity indicating by the residual sensor 8 or 9 and the maximum storing number of the mediums M stored in the medium catalog information PC.

Next, the residual medium estimating part 31 stores the number of the estimated residuals calculated at step S106 in the storage part 40 and makes the display device of the operation display unit 7 display the number of the estimated residuals (step S108).

Next, the residual medium estimating part 31 decides whether or not the number of the estimated residuals is calculated with regard to all of the medium storing parts (the sheet feeding cartridges 3 (3*a*, 3*b*, 3*c*, . . . ) and the manual bypass tray 4) (step S110). If calculation is completed with regard to all of the medium storing parts (step S110: YES), the residual medium estimating part 31 finishes the present calculating process. On the other hand, if there is any medium storing part in which calculation is not completed yet (step S110: NO), the residual medium estimating part 31 shifts process back to step S100 to select the medium storing part in which calculation is not completed yet, and repeats the above-described process of steps S102-S110. As described above, the residual medium estimating part 31 of this example calculates the number of the estimated residuals of the mediums M with regard to each of a plurality of medium storing parts.

6. Technical Effects of the Present Embodiment

As described above, the multifunction peripheral 1 (image forming apparatus) according to the present embodiment includes at least one medium storing part (the sheet feeding cartridge 3 or the manual bypass tray 4) storing the mediums M, the sheet feeding part 16 or 17, the image forming parts 12, the residual sensor 8 or 9, the storage part 40, and the residual medium estimating part 31. The sheet feeding part 16 or 17 feeds the medium M from the medium storing part. The image forming parts 12 perform image forming to the medium M fed from the sheet feeding part 16 or 17. The residual sensor 8 or 9 detects the residual quantity of the mediums M stored in the medium storing part as the relative residual quantity with regard to the maximum storing quantity of the mediums M which can be stored in the medium storing part. The storage part 40 stores the maximum storing number of the mediums M corresponding to the maximum storing quantity of the mediums M of the medium storing part. The residual medium estimating part 31 calculates the number of the estimated residuals of the mediums M stored in the medium storing part on the basis of the relative residual quantity detected by the residual sensor 8 or 9 and the maximum storing number of the mediums M stored in the storage part 40.

In accordance with the above configuration, the number of the residuals of the medium M stored in each medium storing part is appropriately estimated. The residual medium estimating part 31 calculates the number of the estimated residuals of the mediums M on the basis of the relative residual quantity indicated by the residual sensor 8 or 9 and the maximum storing number of the mediums M of the medium storing part. Since the user of the multifunction peripheral 1 can concretely grasp the number of the residuals of the mediums, convenience of the user is improved in comparison with a configuration expressing a residual quantity by a relative value.

Moreover, in the present embodiment, the storage part 40 stores the control standard information JDF including the component control information relating to operation control of image forming and the standard information for each type of the medium M to be the object of image forming, and the medium catalog information PC including the attribute information relating to the medium M for each type of the medium M. To the medium catalog information PC, the maximum storing number of the mediums M for each type of the medium M and for each medium storing part is appended. In accordance with the above configuration, sine the medium catalog information PC including the maximum storing number of the mediums M is stored separately from the control standard information JDF, managing (updating and others) of the maximum storing number of the mediums M of the medium storing part is further facilitated.

Further, in the present embodiment, the residual sensor 8 or 9 detects the relative residual quantity as the discrete value set in stages (e.g. discrete percentage value). In addition, the residual medium estimating part 31 calculates the number of the estimated residuals of the mediums M by multiplying the discrete value indicating the relative residual quantity by the maximum storing number of the mediums M. In accordance with the above configuration, it is possible to calculate the number of the estimated residuals of the mediums M on the basis of the discrete value.

Furthermore, in the present embodiment, the multifunction peripheral 1 includes the plurality of medium storing parts (the sheet feeding cartridges 3 and the manual bypass tray 4) and the residual medium estimating part 31 calculates the number of the estimated residuals of the mediums M about each of the plurality of medium storing parts. In accordance with the above configuration, since the numbers of the estimated residuals of the mediums M are respectively estimated about all of the plurality of medium storing parts, information provided to the user becomes appropriate.

7. Modified Example

The above-described embodiment may be modified variously. Hereinafter, modified examples of the embodiment will be described. Two or more aspects may be arbitrarily chosen from the embodiment and the modified example and appropriately combined in so far as those aspects are not incompatible with each other.

The residual medium estimating part 31 may calculate a first value V1 (a value corresponding to the number of the estimated residuals of the mediums M in the above-described embodiment) by multiplying the discrete value indicating the relative residual quantity by the maximum storing number of the mediums M, calculate a second value V2 by multiplying a discrete value smaller than the discrete value corresponding to the first value V1 by one stage by the maximum storing number of the mediums M, and calculate a middle value Vm equal to or less than the first value and equal to or more than the second value as the number of the estimated residuals of the mediums M.

In the configuration of the above-described embodiment, the number of the estimated residuals of the mediums M is a value obtained by multiplying the discrete value indicating the relative residual quantity by the maximum storing number of the mediums M. In such a case, after the number of the estimated residuals of the mediums M is calculated, a period when the number of the estimated residuals of the mediums M is larger than actual storing number of the mediums M arrives. By contrast, in accordance with a configuration of the modified example, because, for a while after the number of the estimated residuals of the mediums M is calculated, the actual storing number of the mediums M is larger than the number of the estimated residuals of the mediums M, it is possible to maintain a period when a difference between the actual storing number of the mediums M and the number of the estimated residuals of the mediums M is small over a long period.

The residual medium estimating part 31 may add up the numbers of the estimated residuals of the mediums M for each type of the medium M. That is, in a case where the mediums M of the same type (i.e. being equal in all attributes of a size, a paper type and others) are stored in the plurality of medium storing parts, the numbers of the residuals of the mediums M stored in those medium storing parts may be added up. In accordance with a configuration of the modified example, since the number of the estimated residuals of the mediums M of the same type, the user can grasp the number of the residuals of the mediums M for each type of the medium M.

FIG. 7 is a table showing an example of the number of the estimated residuals of the mediums M in a case where the multifunction peripheral 1 includes five sheet feeding cartridges 3 (3*a*-3*e*) and the manual bypass tray 4. As shown in the table, A3 size plain papers are stored in the sheet feeding cartridges 3*b* and 3*c*, and A4 size plain papers are stored in the sheet feeding cartridges 3*d* and 3*e*. In accordance with a calculating manner of the modified example, the numbers of the estimated residuals of A3 size plain papers are added up to become 500 mediums, and the numbers of the estimated residuals of A4 size plain papers are added up to become 2175 mediums.

Moreover, the residual medium estimating part 31 may add up the numbers of the estimated residuals of the mediums M for each medium group including a plurality of types of the mediums M with a same size. That is, if an example of FIG. 7 is applied, the residual medium estimating part 31 may add up the respective numbers of all A4 size mediums M, i.e. the number of A4 size cardboards in the manual bypass tray 4, the number of A4 size recycled papers in the sheet feeding cartridge 3*a*, and the numbers of A4 plain papers in the sheet feeding cartridge 3*d* and 3*e*. In accordance with a configuration of the modified example, the user can grasp the number of the residuals of the mediums M for each size of the medium M.

In the above-described embodiment, the case where the configuration of the present disclosure is applied to the multifunction peripheral 1 as an example of the image forming apparatus is described. However, in other different embodiment, the configuration of the present disclosure may be applied to other image processing apparatus, such as a printer, a copying machine, a facsimile or the like.

Since the description of the above-described embodiments explains preferred embodiments of the multifunction peripheral 1 according to the present disclosure, there may be various technically preferable limitations. However, the scope of the present disclosure is not limited to aspects of the embodiments unless specifically described to limit the present disclosure. Furthermore, components in the above-described embodiments of the present disclosure can be appropriately replaced with existing component or the like, and can be combined with existing component to provide various variations. Moreover, the description of the above-described embodiments of the present disclosure does not limit the content of the disclosure described in the claims.

The invention claimed is:

1. An image forming apparatus comprising:

at least one medium storing part storing mediums;

a sheet feeding part feeding the medium from the medium storing part;

an image forming part performing image forming to the medium fed from the sheet feeding part;

a residual quantity detecting part detecting a residual quantity of the mediums stored in the medium storing part as a relative residual quantity with regard to a maximum storing quantity of the mediums which can be stored in the medium storing part;

a storage part storing maximum storing number of the mediums corresponding to the maximum storing quantity of the mediums of the medium storing part; and a residual medium estimating part calculating number of estimated residuals of the mediums stored in the medium storing part on the basis of the relative residual quantity detected by the residual quantity detecting part and the maximum storing number of the mediums stored in the storage part.

2. The image forming apparatus according to claim 1, wherein the storage part storing:

control standard information including component control information relating to operation control of image forming, and standard information for each type of the medium to be an object of image forming; and medium catalog information including attribute information relating to the medium for each type of the medium, to the medium catalog information, the maximum storing number of the mediums for each type of the medium and for each medium storing part is appended.

3. The image forming apparatus according to claim 1, wherein the residual quantity detecting part detects the relative residual quantity as discrete value set in stages.

4. The image forming apparatus according to claim 3, wherein the residual medium estimating part calculates the number of the estimated residuals of the mediums by multiplying the discrete value indicating the relative residual quantity by the maximum storing number of the mediums.

5. The image forming apparatus according to claim 3, wherein the residual medium estimating part calculates a first value by multiplying the discrete value indicating the relative residual quantity by the maximum storing number of the mediums, calculates a second value by multiplying a discrete value smaller than the discrete value corresponding to the first value by one stage by the maximum storing number of the mediums, and calculates a middle value equal to or less than the first value and equal to or more than the second value as the number of the estimated residuals of the mediums.

6. The image forming apparatus according to claim 1, wherein the medium storing part includes a plurality of medium storing parts, the residual medium estimating part calculates the number of the estimated residuals of the mediums with regard to each of the plurality of medium storing parts.

7. The image forming apparatus according to claim 6, wherein the residual medium estimating part adds up numbers of the estimated residuals of the mediums for each type of the medium.

8. The image forming apparatus according to claim 6, wherein the residual medium estimating part adds up numbers of the estimated residuals of the mediums for each medium group including a plurality of types of the mediums with a same size.

9. The image forming apparatus according to claim 6, wherein the plurality of medium storing parts include a sheet feeding cartridge being a standard cartridge, a sheet feeding cartridge being a large capacity deck, and a manual bypass tray.

10. The image forming apparatus according to claim 1 further comprising:

a display part, wherein the residual medium estimating part stores the number of the estimated residuals in the storage part and displays the number of the estimated residuals on the display part.

* * * * *